US009657669B2

(12) United States Patent
Dölker

(10) Patent No.: US 9,657,669 B2
(45) Date of Patent: May 23, 2017

(54) METHOD FOR CONTROLLING RAIL PRESSURE

(75) Inventor: Armin Dölker, Friedrichshafen (DE)

(73) Assignee: MTU Friedrichshafen GmbH, Friedrichshafen (DE)

( * ) Notice: Subject to any disclaimer, the term of this patent is extended or adjusted under 35 U.S.C. 154(b) by 687 days.

(21) Appl. No.: 14/125,230

(22) PCT Filed: Jun. 5, 2012

(86) PCT No.: PCT/EP2012/002391
§ 371 (c)(1),
(2), (4) Date: Jan. 29, 2014

(87) PCT Pub. No.: WO2012/167916
PCT Pub. Date: Dec. 13, 2012

(65) Prior Publication Data

US 2014/0156168 A1 Jun. 5, 2014

(30) Foreign Application Priority Data

Jun. 10, 2011 (DE) ..... 10 2011 103 988

(51) Int. Cl.
*F02D 41/14* (2006.01)
*F02D 41/38* (2006.01)
*F02D 41/28* (2006.01)

(52) U.S. Cl.
CPC ..... *F02D 41/14* (2013.01); *F02D 41/3845* (2013.01); *F02D 2041/1432* (2013.01);
(Continued)

(58) Field of Classification Search
CPC ..... F02D 41/14; F02D 41/3845; F02D 2041/3881; F02D 2200/0602;
(Continued)

(56) References Cited

U.S. PATENT DOCUMENTS 5,433,182 A 7/1995 Augustin et al.
5,533,492 A * 7/1996 Willey ..... F02D 41/0027 123/488
(Continued)

FOREIGN PATENT DOCUMENTS

DE 4335171 C1 5/1995
DE 10029349 A1 10/2001
(Continued)

OTHER PUBLICATIONS

English language abstract of DE-102007034317.
(Continued)

*Primary Examiner* — Hung Q Nguyen
*Assistant Examiner* — Brian Kirby
(74) *Attorney, Agent, or Firm* — Reising Ethington PC

(57) ABSTRACT

Proposed is a method for closed loop rail pressure control of a V-type internal combustion engine with an asymmetrical firing order, wherein an actual rail pressure is computed from the measured rail pressure; a system deviation is determined by means of the actual rail pressure and a set rail pressure; and wherein a correcting variable for actuating a pressure actuating element, in particular a suction throttle, for regulating the rail pressure is computed. The invention is characterized by the fact that the actual rail pressure is computed from the measured rail pressure by means of an averaging filter in that below a limit speed (nLi) the rail pressure is averaged over a constant time and in that above the limit speed (nLi) the rail pressure is averaged over a working cycle of the internal combustion engine.

18 Claims, 4 Drawing Sheets

(52) U.S. Cl.
CPC ..... *F02D 2041/286* (2013.01); *F02D 2041/3881* (2013.01); *F02D 2200/0602* (2013.01)

(58) Field of Classification Search
CPC ..... F02D 2041/1432; F02D 2041/286; F02D 2041/1417; F02D 41/3836; F02D 2250/31; F02D 2041/1409; F02D 2041/1418; F02D 2041/288; F02D 2250/04; F02D 41/222; F02D 41/3809; F02D 2041/1422; F02D 2041/223; F02D 2200/0618; F02D 2250/14; F02D 41/1497; F02D 41/32; F02D 2041/141; F02D 2041/1412; F02D 2041/1415; F02D 2041/1419; F02D 2041/142; F02D 2041/1431; F02D 2041/1433; F02D 2041/1434; F02D 2041/224; F02D 2041/228; F02D 2400/08; F02D 31/001; F02D 41/0032; F02D 41/008; F02D 41/009; F02D 41/0205; F02D 41/045; F02D 41/062; F02D 41/123; F02D 41/1402; F02D 41/221; F02D 41/2441; F02D 41/2474; F02M 63/0225; F02M 63/023
USPC ..... 701/102, 103–107; 123/447, 456, 494, 123/446, 478, 198 D, 305, 349, 350, 352, 123/357, 390, 436, 457, 467, 488, 520; 73/114.43, 114.51, 114.41, 114.49
See application file for complete search history.

(56) References Cited

U.S. PATENT DOCUMENTS 5,535,621 A * 7/1996 Glidewell ..... F02D 41/221 123/478
5,609,136 A * 3/1997 Tuken ..... F02D 41/14 123/357
5,699,772 A * 12/1997 Yonekawa ..... F02D 41/3082 123/497
5,806,497 A * 9/1998 Hosoya ..... F02D 41/045 123/488
6,085,727 A * 7/2000 Nakano ..... F02D 41/1401 123/447
6,131,551 A * 10/2000 Jamrog ..... F02D 41/0032 123/198 D
6,170,459 B1 * 1/2001 Ono ..... F02D 41/3836 123/305
6,349,702 B1 * 2/2002 Nishiyama ..... F02D 41/3836 123/447
6,581,574 B1 * 6/2003 Moran ..... F02D 41/2464 123/494
6,840,228 B2 * 1/2005 Yomogida ..... F02D 41/3836 123/447
7,010,415 B2 * 3/2006 Dolker ..... F02D 41/222 123/456
7,069,904 B2 * 7/2006 Dolker ..... F02D 31/001 123/352
7,210,458 B2 * 5/2007 Walther ..... F02D 41/3836 123/446
7,267,106 B2 * 9/2007 Adachi ..... F02D 41/3836 123/436
7,270,115 B2 * 9/2007 Dolker ..... F02D 41/3845 123/447
7,317,983 B2 * 1/2008 Ishizuka ..... F02D 41/008 123/350
7,376,505 B2 * 5/2008 Skala ..... F02D 41/0082 123/406.23
7,610,901 B2 * 11/2009 Bucher ..... F02D 41/221 123/457
7,900,605 B2 * 3/2011 Dingle ..... F02D 41/3827 123/447
8,950,379 B2 * 2/2015 Hattar ..... F02D 41/222 123/456
2004/0107944 A1 6/2004 Yomogida et al.
2006/0130569 A1 * 6/2006 Walther ..... F02D 41/3836 73/114.51
2009/0007647 A1 * 1/2009 Kraemer ..... F02D 41/222 73/114.43
2009/0082941 A1 * 3/2009 Nakata ..... F02D 41/222 701/103
2010/0024773 A1 * 2/2010 Doelker ..... F02D 31/007 123/456
2010/0030450 A1 * 2/2010 Doelker ..... F02D 41/3809 701/103
2012/0210976 A1 * 8/2012 Dolker ..... F02D 41/14 123/390
2012/0226428 A1 * 9/2012 Dolker ..... F02D 41/222 701/103
2014/0074382 A1 * 3/2014 Methil-Sudhakaran ..... F02D 41/1401 701/107

FOREIGN PATENT DOCUMENTS

DE 102005008364 B3 8/2006
DE 102006049266 B3 3/2008
DE 102007034317 A1 * 1/2009 ..... F02D 41/3845
DE 102007034317 A1 1/2009
EP 1429015 A2 6/2004

OTHER PUBLICATIONS

English language abstract of DE-102005008364.
PCT International Search Report dated Sep. 30, 2013 for PCT/EP2012/002391.

* cited by examiner

METHOD FOR CONTROLLING RAIL PRESSURE

TECHNICAL FIELD

The present disclosure relates to a method for closed loop rail pressure control, e.g., of a V-type internal combustion engine with an asymmetrical firing order.

BACKGROUND

V-type internal combustion engines have a rail or bank of cylinders on a first side, i.e., the A side and also on a second side, i.e., the B side, for temporary storage of the fuel. The injectors, which are connected to the rail, inject the fuel into the combustion chambers. In a first design of the common rail system a single high pressure pump pumps the fuel in parallel into both rails by increasing the pressure conditions. Therefore, both rails exhibit the same rail pressure. A second design of the common rail system differs from the first design in that a first high pressure pump pumps the fuel into a first rail; and a second high pressure pump pumps the fuel into a second rail. Both designs are known, for example, from DE 43 35 171 C1.

Since the quality of the combustion depends crucially on the pressure level in the rail, this pressure level may be automatically controlled. Typically a closed loop rail pressure control circuit comprises a pressure controller, the suction throttle with a high pressure pump and the rail as the controlled system, as well as a software filter in the feedback branch. In this closed loop rail pressure control circuit the pressure level in the rail corresponds to the correcting variable. The measured raw values of the rail pressure are converted by the filter to an actual rail pressure and compared with a set rail pressure. Then the resulting system deviation is converted by means of the pressure controller into an actuating signal for the suction throttle. The actuating signal corresponds to a volume flow in units of liters per minute. This actuating signal is implemented electrically as a PWM (pulse width modulated) signal. A corresponding closed loop rail pressure control circuit is known from DE 10 2006 049 266 B3.

DE 10 2007 034 317 A1 describes a V-type internal combustion engine with an asymmetrical firing order and an independent A-side common rail system and an independent B-side common rail system. The conditions for an asymmetrical firing order are met, when, for example, the cylinder A1, i.e. the first cylinder on the A side, is ignited; and thereafter the cylinder A2, i.e. the second cylinder on the A side, is ignited. The asymmetrical firing order in turn causes pressure variations in the rail. In order to solve this problem, DE 10 2007 034 317 A1 proposes an equalization line between the two rails in a first solution. In a second solution the rail pressure on the A side is regulated with a proportional-integral (PI) controller in a closed loop rail pressure control circuit on the A side; and the rail pressure on the B side is regulated with a proportional (P) control in a closed loop rail pressure control circuit on the B side. Owing to the lack of an integral (I) component on the B side in the controller, this solution is critical with respect to a steady state system deviation.

SUMMARY

Accordingly, there is a need for an improved method for closed loop rail pressure control in a V-type internal combustion engine with an asymmetrical firing order.

This engineering object is achieved by means of an exemplary method that is designed for closed loop rail pressure control as described herein According to one exemplary illustration, the actual rail pressure is computed from the measured rail pressure by means of an averaging filter in that below a limit speed the rail pressure is averaged over a constant time and that above the limit speed the rail pressure is averaged over a working cycle of the internal combustion engine. A working cycle may be defined as two revolutions of the crankshaft. This solution has proven to be particularly useful when an internal combustion engine is being used to power a generator. In this case the engine speed typically goes through various speed ranges while the engine is running. In the steady state speed operating range, for example, at a constant engine speed of 1,500 revolutions per minute in order to generate a 50 Hz power line frequency, the periodic variations of the rail pressure over the working cycle are filtered out by averaging the rail pressure over a working cycle of the internal combustion engine. On the other hand, in a speed range below the steady state speed operating range, for example a speed range of zero revolutions up to a limit speed of 1,000 revolutions per minute, the rail pressure is averaged over a constant time. The net result of this measure is that the signal of the actual rail pressure below the limit speed is not delayed too much, a feature that in turn now enables a satisfactory control of the rail pressure. Therefore, a stabilization of the closed loop rail pressure control circuit below the limit speed is advantageous.

Hence, when an internal combustion engine is used to power a generator, it may be generally ensured that in the steady state speed operating range the rail pressure is averaged reliably over one working cycle, because the rail pressure variations are periodic over a working cycle. On the other hand, in the speed range below the limit speed, an exact averaging over a working cycle and, thus, also an exact filtering out of the periodic variations of the rail pressure over a working cycle is not necessary, because the range below the limit speed is traversed solely in accordance with the system's dynamic response pattern; therefore, it is not even possible for a sustainable development of rail pressure variations to occur in this range.

In one exemplary approach, the averaging filter is combined with a low-pass filter, as a result of which the high frequency rail pressure variations, which are not periodic over a working cycle, are damped.

The method can be used in both a V-type internal combustion engine with an asymmetrical firing order and with an independent common rail system on the A side and an independent common rail system on the B side, as well as in a V-type internal combustion engine with an asymmetrical firing order, wherein a single high pressure pump pumps the fuel simultaneously into the A-side rail and the B-side rail.

BRIEF DESCRIPTION OF THE DRAWINGS

While the claims are not limited to the illustrated embodiments, an appreciation of various aspects is best gained through a discussion of various examples thereof. Referring now to the drawings, illustrative embodiments are shown in detail. Although the drawings represent the embodiments, the drawings are not necessarily to scale and certain features may be exaggerated to better illustrate and explain an innovative aspect of an embodiment. Further, the embodiments described herein are not intended to be exhaustive or otherwise limiting or restricting to the precise form and configuration shown in the drawings and disclosed in the following detailed description. Exemplary embodiments of the present invention are described in detail by referring to the drawings as follows:

DETAILED DESCRIPTION

Figure 1:
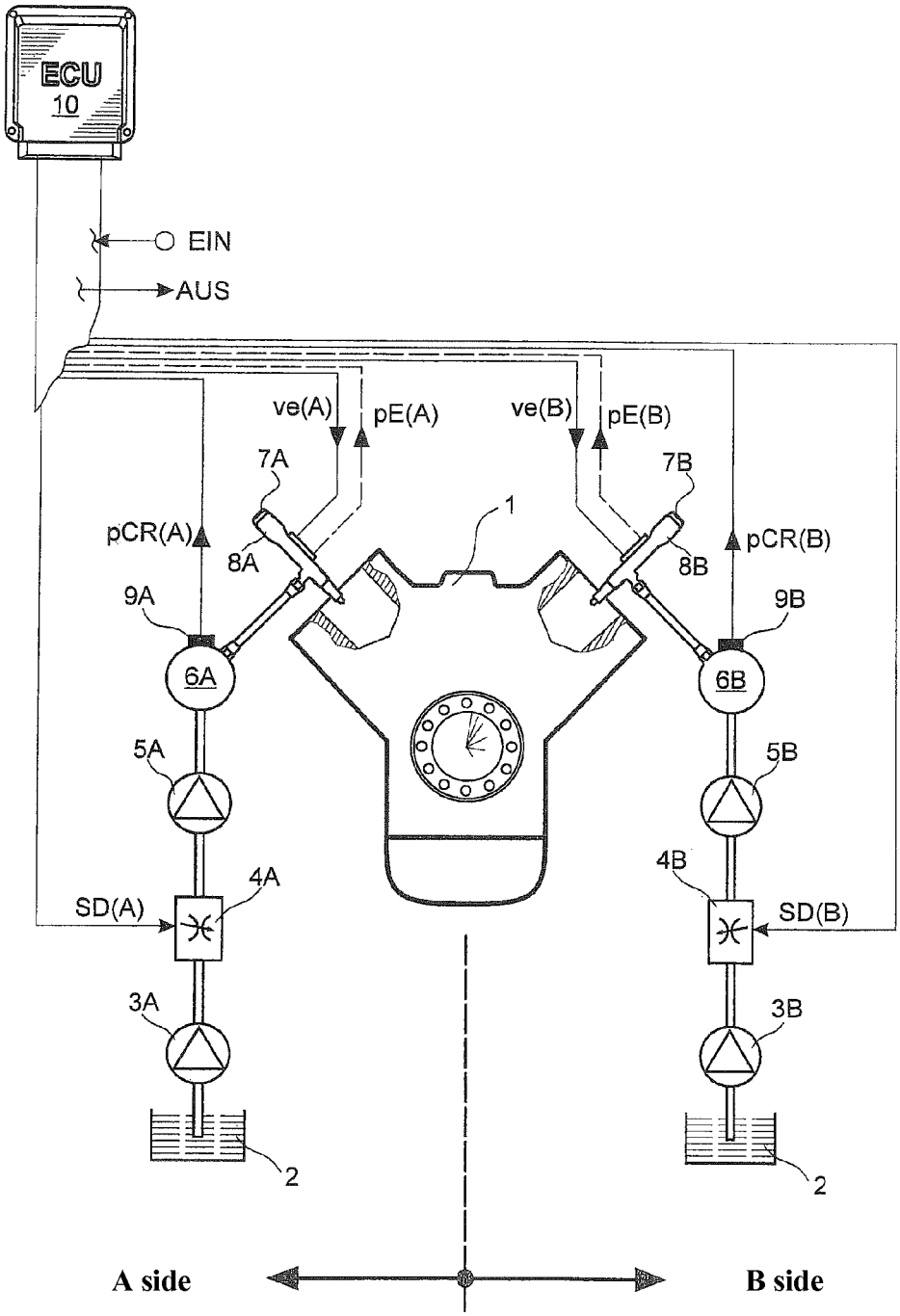
FIG. 1 a system diagram, according to an exemplary approach.

FIG. 1 shows a system diagram of an exemplary electronically controlled internal combustion engine 1 with a common rail system on a first side, i.e., the A side, and a common rail system on a second side, i.e., the B side. The common rail system on the A side comprises the following mechanical components: a low pressure pump 3A for pumping fuel from a tank 2, a suction throttle 4A for influencing the volume flow, a high pressure pump 5A, a rail 6A, and injectors 7A for injecting fuel into the combustion chambers of the internal combustion engine 1. The common rail system on the B side comprises the same mechanical components, which in turn have the same reference numerals, to which the suffix B has been added.

The internal combustion engine 1 may be controlled by means of an electronic engine control unit (ECU) 10. As examples of the input variables of the electronic engine control unit 10, FIG. 1 shows an A-side rail pressure pCR(A), a B-side rail pressure pCR(B), and a variable EIN. The A-side rail pressure pCR(A) may be detected by means of an A-side rail pressure sensor 9A. The B-side rail pressure pCR(B) may be detected by means of a B-side rail pressure sensor 9B. The variable EIN stands for the other input signals, for example, an engine speed or an engine power output desired by the operator. The illustrated output variables of the electronic engine control unit 10 are a PWM signal SD(A) for actuating the A-side suction throttle 4A, a power-determining signal ve(A) for actuating the A-side injectors 7A, for example the injection start/injection end, a PWM signal SD(B) for actuating the B-side suction throttle 4B, a power-determining signal ve(B) for actuating the B-side injectors 7B, and a variable AUS. The latter stands for the additional actuating signals for controlling the internal combustion engine 1, for example, an actuating signal for actuating an EGR valve. The common rail system that is depicted can also be designed as a common rail system with individual accumulators. In this case then an individual accumulator 8A is integrated in the injector 7A, and an individual accumulator 8B is integrated in the injector 7B as an additional buffer volume for the fuel. Then the individual accumulator pressure levels pE(A) and pE(B) are the additional input variables of the electronic engine control unit 10. The characterizing feature of the illustrated embodiment is the mutually independent closed loop control of the A-side rail pressure pCR(A) and the independent closed loop control of the B-side rail pressure pCR(B).

Figure 2:
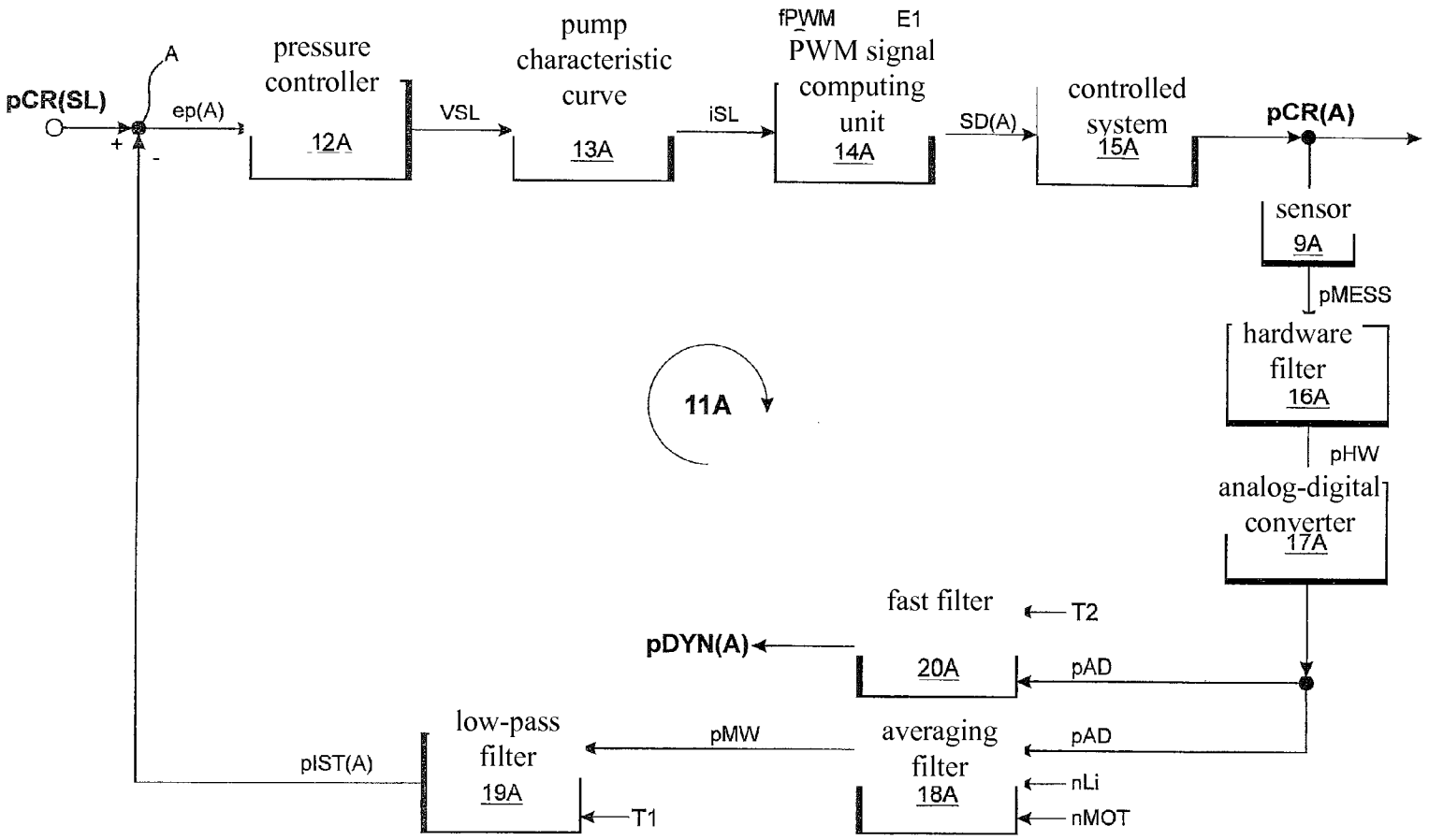
FIG. 2 a block diagram of the closed loop rail pressure control circuit, according to an exemplary illustration, FIG. 3 a characteristic curve, according to an exemplary illustration, FIG. 4 a timing graph, according to an exemplary illustration, and FIG. 5 a program flow chart, according to an exemplary illustration.

FIG. 2 shows a block diagram of the A-side closed loop rail pressure control circuit, according to an exemplary illustration, which is marked with the reference numerals bearing the suffix A. The configuration of both closed loop control circuits may be identical. The A-side closed loop rail pressure control circuit 11A is described below. In this case its description also applies analogously to the B-side closed loop rail pressure control circuit. The reference input variable for both closed loop rail pressure control circuits is identical, in this case: a common set rail pressure pCR(SL). The set rail pressure is computed as a function of a set torque or as a function of the set injection quantity and the engine speed.

The input variables of the closed loop rail pressure control circuit 11A are the set rail pressure pCR(SL), a base frequency fPWM for the PWM signal, a variable E1, the engine speed nMOT, a time constant T1 and a time constant T2. The input variable E1 comprises the battery voltage and the ohmic resistance of the suction throttle, including the lead wire; and these input variables go into the computation of the actuating signal SD(A) for the suction throttle 4A. The output variables of the A-side closed loop rail pressure control circuit are the raw values of the rail pressure pCR (A). The raw values of the rail pressure pCR(A) are measured by the rail pressure sensor 9A on the A side. Then the output signal pMESS of this A-side rail pressure sensor is filtered by means of a hardware filter 16A with PT1 action and a cutoff frequency of 20 Hz. The output values pHW are digitized by means of an analog-digital converter 17A. Then the output values pAD of the analog-digital converter 17A are further processed by means of two information paths. A first information path comprises an averaging filter 18A and an optional low-pass filter 19A. The first information path corresponds to a slow filtering, by means of which the actual rail pressure pIST(A) is determined. The averaging filter 18A has the engine speed nMOT and the limit speed nLi as additional input variables. The averaging filter 18A is used to determine whether the averaging of the rail pressure is performed over a working cycle, i.e. two revolutions of the crankshaft, or over a constant time. The switching over between the two methods for averaging takes place at the limit speed nLi. Then the output variable pMW of the averaging filter 18A is further processed, as shown, by the low-pass filter 19A, which has a time constant T1 as the input variable. In practice a value of T1=16 ms may be used for the time constant, and this value of T1=16 ms corresponds to a frequency of 10 Hz. High frequency rail pressure variations, which are not periodic over a working cycle, may be damped by means of the low-pass filter 19A. A second information path comprises a fast filter 20A with PT1 action. In this case the fast filter 20A has a smaller time constant and, as a result, a shorter phase lag than the averaging filter 18A and the optional low-pass filter 19A. The output value pDYN(A) of the fast filter 20A is used, among other things, to perform a fast current feed to the suction throttle, as a result of which in the event of a load dump a higher dynamic response is achieved.

The actual rail pressure pIST(A) may be compared with the set rail pressure pCR(SL) at a point A. This comparison yields the system deviation ep(A), from which a pressure controller 12A with at least PID action computes a set volume flow VSL as the correcting variable. The set volume flow VSL has the physical unit of liters per minute. Thereafter the set volume flow is limited (not illustrated); and an electric set current iSL is assigned to the set volume flow VSL by means of a pump characteristic curve 13A. The set current iSL is converted to a PWM signal SD(A) in a computing unit 14A. The PWM signal SD(A) is the duty cycle, and the frequency fPWM corresponds to the base frequency of the PWM signal SD(A). The conversion takes into consideration, among other things, the fluctuations of the operating voltage and the ohmic resistance of the suction throttle, including the electric lead wires. Then the solenoid coil of the suction throttle on the A side is acted upon by the PWM signal SD(A). The net result is a change in the path of the magnetic core, by which the pumping current of the high pressure pump is freely influenced. The high pressure pump 5A, the suction throttle 4A and the rail 6A constitute an A-side controlled system 15A. As a result, the A-side closed loop control circuit 11A is closed.

Figure 3:
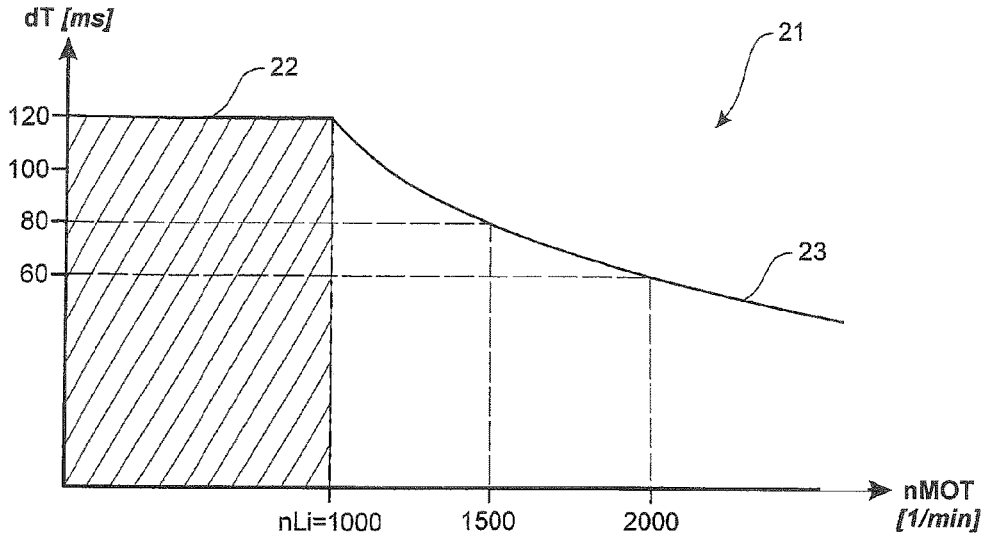

FIG. 3 shows a characteristic curve 21. The characteristic curve 21 is used to compute the averaging time dT as a function of the engine speed nMOT. Thus, the averaging time dT corresponds to the time, over which the rail pressure values are averaged by the averaging filter (FIG. 2: 18A). The characteristic curve 21 comprises a straight line 22, which runs parallel to the abscissa, and a hyperbola 23. When the engine speed values are less than the limit speed nLi=1,000 l/min, a constant averaging time dT=120 ms is determined by means of the straight line 22. This range is shown with diagonal hatching in FIG. 3. The averaging time dT=120 ms is computed from the duration of one working cycle at a speed of 1,000 l/min. One working cycle corresponds to two revolutions of the crankshaft of the internal combustion engine, i.e. 720° crankshaft angle. Below the limit speed nLi the rail pressure is filtered at a constant averaging time dT=120 ms. When the engine speed values nMOT are greater than the limit speed nLi=1,000 l/min, the averaging time dT corresponds to a working cycle that yields the hyperbola 23. Thus, for example, when the engine speed nMOT is equal to 1,500 l/min (nMOT=1,500 l/min), the averaging time dT is equal to 80 ms (dT=80 ms); or when the engine speed nMOT is equal to 2,000 l/min (nMOT=2,000 l/min), the averaging time dT is equal to 60 ms (dT=60 ms).

Figure 4A:
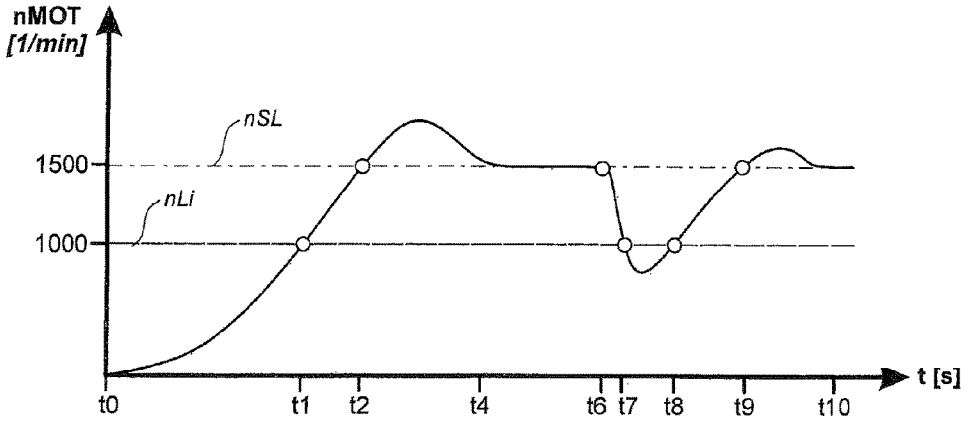
Figure 4B:
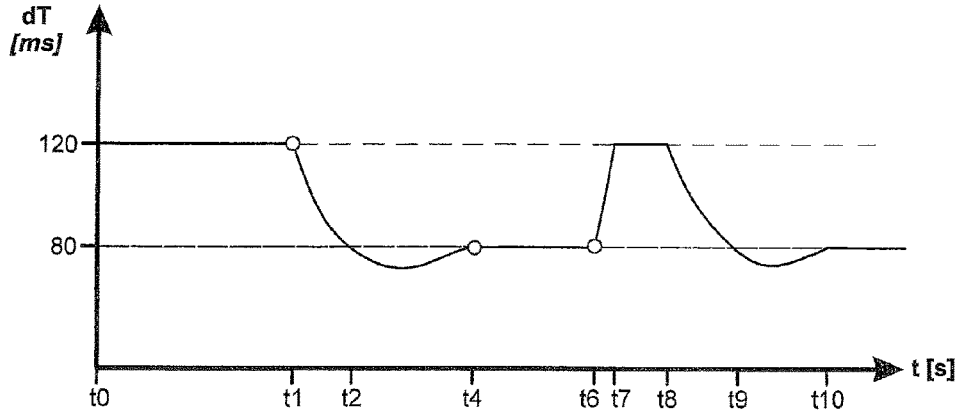
Figure 4C:
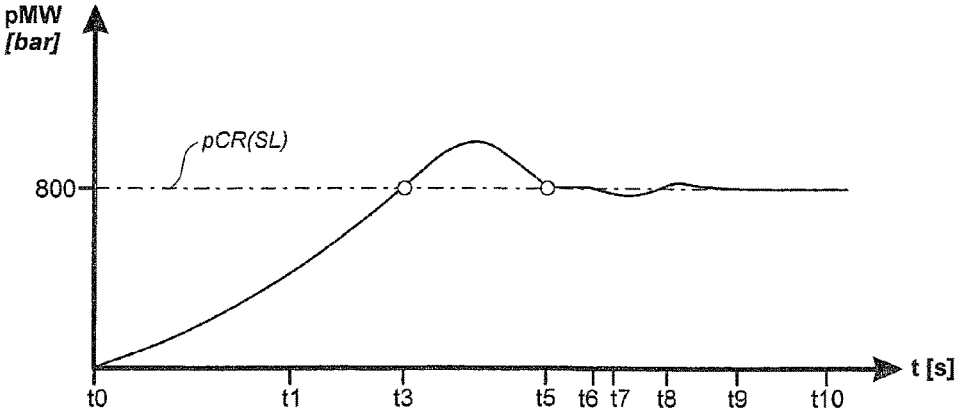

FIG. 4 consists of the partial FIGS. 4A to 4C, which show various state variables. The following are plotted over the time t: the engine speed nMOT in FIG. 4A, the averaging time dT in FIG. 4B and the averaged rail pressure pMW in FIG. 4C.

FIG. 4A shows the starting process and a load increase in an internal combustion engine being used to power a generator, according to an exemplary illustration. The set speed nSL is indicated by the dashed-dotted line in FIG. 4A; and the limit speed nLi is indicated by the dashed line in FIG. 4A. The set speed remains constant at nSL=1,500 l/min, which corresponds to a frequency of 50 Hz. The engine speed nMOT reaches the limit speed of nLi=1,000 l/min at the time t1. At the time t2 the set speed of nSL=1,500 l/min is reached. After a speed overshoot, the engine speed nMOT is swung back to the set speed nSL at time t4. At time t6 there is an increase in the load, which causes the engine speed nMOT to drop. In the time period between t7 and t8 the engine speed falls below the limit speed nLi. At this point more fuel is injected because of the deviation between the set and actual value of the engine speed, so that the engine speed nMOT increases again. At time t9 the engine speed nMOT reaches again the speed level of the set speed nSL and has swung back to the set speed nSL at time t10.

FIG. 4B shows the averaging time dT, over which the rail pressure values, for example the A-side rail pressure pCR(A), are averaged. Up until the time t1, the engine speed nMOT is less than the limit speed nLi. Therefore, the characteristic curve in FIG. 3 is used to compute a constant averaging time dT=120 ms. In the speed range below the limit speed nLi, an exact averaging over a working cycle is not necessary, because this range is traversed only in accordance with the system's dynamic response pattern and, therefore, absolutely rules out any possibility of a variation of the rail pressure developing in this range. The averaging over a constant time has a stabilizing effect on the closed loop rail pressure control, because the signal of the actual rail pressure is not delayed too much. After the time t1, the engine speed nMOT is greater than the limit speed nLi. At this point the averaging time dT is computed as a function of the engine speed nMOT and, in particular, by means of the hyperbola in FIG. 3. According to this hyperbola, the averaging time dT drops as the engine speed nMOT increases. Since at this point the rail pressure is averaged over a working cycle of the internal combustion engine, the periodic variations of the rail pressure over a working cycle are filtered out.

At time t4 the engine speed nMOT has swung back to the set speed nSL=1,500 l/min. At the same time the averaging time has also swung back to the value dT=80 ms. If at this point a load increase takes place at time t6, then the averaging time dT increases due to the drop in the engine speed. In the time period between t7 and t8, the engine speed falls below the limit speed nLi=1,000 l/min. At this point the characteristic curve shown in FIG. 3, in this case the straight line 22, is used to compute a constant averaging time of dT=120 ms. Starting at the time t8, the engine speed nMOT increases again beyond the limit speed nLi, so that at this point the averaging time is computed again as a function of the engine speed (FIG. 3: hyperbola 23).

The graph from FIG. 4C shows the averaged rail pressure pMW, which increases at first and then reaches the constant set rail pressure pCR(SL)=800 bar at time t3. Having overshot this constant set rail pressure, the averaged rail pressure PMW swings back to the set rail pressure pCR(SL) at time t5. As shown, the speed undershoot, generated by the increase in load, has only a slight impact on the averaged rail pressure pMW.

Figure 5:
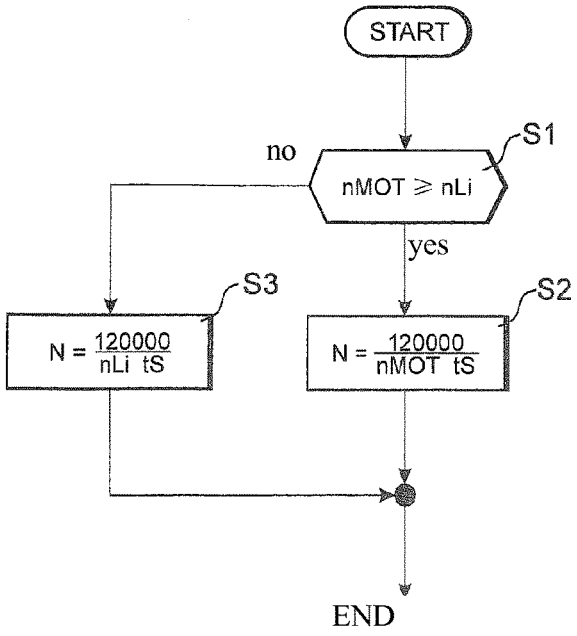

FIG. 5 shows the process in a program flow chart as a subroutine, according to one example. At S1 the subroutine checks whether the engine speed nMOT is greater than or equal to the limit speed nLi. In practice nLi=1,000 l/min is selected. If the engine speed nMOT is above the limit speed nLi, i.e., the query result S1 is yes; then at S2 the number of the values N, over which the rail pressure is averaged, is computed as a function of the engine speed nMOT and the sampling time tS. For nMOT=1,500 l/min and a sampling time of tS=1 ms, the result is a number of N=80 values. If the engine speed nMOT is less than the limit speed nLi, i.e., the query result S1 is no; then at S3 the number N is not computed as a function of the engine speed nMOT, but rather by means of the constant preset limit speed nLi. For a limit speed of nLi=1,000 l/min, the result is N=120 values. Thereafter, the program flow chart may be terminated.

The exemplary illustrations are not limited to the previously described examples. Rather, a plurality of variants and modifications are possible, which also make use of the ideas of the exemplary illustrations and therefore fall within the protective scope. Accordingly, it is to be understood that the above description is intended to be illustrative and not restrictive.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claimed invention.

Accordingly, it is to be understood that the above description is intended to be illustrative and not restrictive. Many embodiments and applications other than the examples provided would be upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In sum, it should be understood that the invention is capable of modification and variation and is limited only by the following claims.

All terms used in the claims are intended to be given their broadest reasonable constructions and their ordinary meanings as understood by those skilled in the art unless an explicit indication to the contrary in made herein. In particular, use of the singular articles such as "a," "the," "the," etc. should be read to recite one or more of the indicated elements unless a claim recites an explicit limitation to the contrary.

The invention claimed is:

1. A method for closed loop rail pressure control of a V-type internal combustion engine with an asymmetrical firing order, wherein an actual rail pressure is computed from the measured rail pressure; a system deviation is determined by means of the actual rail pressure and a set rail pressure; and wherein a correcting variable for actuating a pressure actuating element, in particular a suction throttle, for regulating the rail pressure is computed, wherein the actual rail pressure is computed from the measured rail pressure with an averaging filter, and wherein the rail pressure is averaged over a constant time below a limit speed, and the rail pressure is averaged over a working cycle of the internal combustion engine above the limit speed, wherein the suction throttle is actuated based upon the computed correcting variable.

2. A method, as claimed in claim 1, wherein, the actual rail pressure is computed using a low-pass filter.

3. A method, as claimed in claim 1, wherein the rail pressure of the common rail system on a first side is regulated using a first-side closed loop rail pressure control circuit; and the rail pressure of the common rail system on a second side is regulated using a second-side closed loop rail pressure control circuit; and both closed loop rail pressure control circuits are automatically controlled independently of each other; and a common set rail pressure is established as the reference input variable for both closed loop rail pressure control circuits.

4. A method, as claimed in claim 3, wherein the common set rail pressure is computed as a function of:

a set torque or the set injection quantity and the engine speed.

5. A method, as claimed in claim 3, wherein the first side is an A-side of the engine, and the second side is a B-side of the engine.

6. The method of claim 1, further comprising determining the limit speed based upon a system dynamic response pattern, wherein a rail pressure variation above the limit speed does not occur below the limit speed.

7. The method of claim 1, wherein the limit speed is an engine speed.

8. The method of claim 7, wherein the limit speed is 1000 revolutions per minute (RPM).

9. The method of claim 1, wherein averaging the rail pressure over the working cycle of the internal combustion engine above the limit speed uses a smaller averaging period than averaging the rail pressure over the constant time below the limit speed.

10. A method for closed loop rail pressure control of a V-type internal combustion engine with an asymmetrical firing order, comprising:

determining (a) an actual rail pressure from a measured rail pressure, (b) a system deviation from at least the actual rail pressure and a set rail pressure, and (c) a correcting variable for actuating a suction throttle configured to regulate the rail pressure;

wherein the actual rail pressure is determined from the measured rail pressure with an averaging filter, the averaging filter averaging rail pressure over a constant time below a limit speed, the averaging filter averaging rail pressure over a working cycle of the internal combustion engine above the limit speed; and actuating the suction throttle based upon at least the determined correcting variable.

11. A method, as claimed in claim 10, wherein, the actual rail pressure is computed using a low-pass filter.

12. A method, as claimed in claim 10, wherein the rail pressure of the common rail system on a first side is regulated using a first-side closed loop rail pressure control circuit; and the rail pressure of the common rail system on a second side is regulated using a second-side closed loop rail pressure control circuit; and both closed loop rail pressure control circuits are automatically controlled independently of each other; and a common set rail pressure is established as the reference input variable for both closed loop rail pressure control circuits.

13. A method, as claimed in claim 12, wherein the common set rail pressure is computed as a function of:

a set torque, or the set injection quantity and the engine speed.

14. A method, as claimed in claim 12, wherein the first side is an A-side of the engine, and the second side is a B-side of the engine.

15. The method of claim 10, further comprising determining the limit speed based upon a system dynamic response pattern, wherein a rail pressure variation above the limit speed does not occur below the limit speed.

16. The method of claim 15, wherein the limit speed is an engine speed.

17. The method of claim 15, wherein the limit speed is 1000 revolutions per minute (RPM).

18. The method of claim 10, wherein averaging the rail pressure over the working cycle of the internal combustion engine above the limit speed uses a smaller averaging period than averaging the rail pressure over the constant time below the limit speed.

* * * * *